US006773545B2

(12) United States Patent
Tanner et al.

(10) Patent No.: US 6,773,545 B2
(45) Date of Patent: Aug. 10, 2004

(54) METHOD OF FORMING AND METERING FLUFF PULP

(75) Inventors: James Jay Tanner, Winneconne, WI (US); Harold Jay Koller, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/337,626

(22) Filed: Jan. 7, 2003

(65) Prior Publication Data

US 2003/0089478 A1 May 15, 2003

Related U.S. Application Data

(62) Division of application No. 09/748,423, filed on Dec. 26, 2000, now Pat. No. 6,524,442.

(51) Int. Cl.[7] ..... D01G 7/00; D01G 7/08

(52) U.S. Cl. ..... 162/20; 162/28; 162/52; 19/80 R; 164/116; 241/24.19; 241/24.29; 241/28

(58) Field of Search ..... 162/20, 28, 52, 162/261; 19/80 R, 82, 97, 97.5; 241/24.29, 24.19, 28, 100.1, 101.01, 101.5, 101.73, 186.4, 186.2, 24.27; 264/115, 116; 425/80.1, 82.1

(56) References Cited

U.S. PATENT DOCUMENTS 3,066,878 A 12/1962 Wildbolz
3,085,296 A 4/1963 Meinicke
3,286,745 A 11/1966 Meis (List continued on next page.)

FOREIGN PATENT DOCUMENTS

EP 0 331 212 A2 9/1989

OTHER PUBLICATIONS

Ferris, Dr. James L., "Absorbent Product Quality—The Role of Fluff Pulp", *Nonwovens Industry*, Oct. 1983, pp. 11–20.

Leuthold, Doug, "New Technology For Dry Defibration of Fluff Pulp", *The New Nonwovens World*, Fall 1992, pp. 78–80.

Quimby, G. R. and Parham, R. A., "Fluff Quality of High–Brightness Market Pulps", *TAPPI*, vol. 64, No. 3, Mar. 1981.

*Primary Examiner*—Steve Alvo
(74) *Attorney, Agent, or Firm*—Pauley Petersen & Erickson

(57) ABSTRACT

The present invention is directed to a method and apparatus for fiberizing bales of pulp into substantially dry fibers and fiber aggregates, i.e., dry fluff, and metering the resulting dry fluff to a receptacle or other process, such as an airlaid process for making disposable absorbent articles. One version of an apparatus having features of the present invention includes: a bale support member for supporting a bale of pulp, the bale support member defining two openings; two rotatable fiberizing assemblies having disrupting elements protruding through the openings an adjustable distance above the bale support member to contact a surface layer of the bale of pulp, the surface layer having a dimension parallel to the longitudinal axis of the fiberizing assembly, each disrupting element extending longitudinally and substantially continuously along the fiberizing assembly for a distance of 100% or more of said surface-layer dimension; a transportation assembly for moving the bale of pulp back and forth along the bale support member and over the openings so that the disrupting elements contact a surface layer in the bale to form substantially dry, individual fibers and fiber aggregates, i.e. dry fluff; an adjustable reciprocating assembly attached to and providing a motive force for moving the transportation assembly, the adjustable reciprocating assembly permitting adjustment of the frequency by which the transportation assembly moves back and forth over the opening; and a conduction assembly for conducting the dry fluff to a hopper or other receptacle, or another process such as an airlaid process. One method having features of the present invention involves using the aforementioned equipment to fiberize bales of pulp into dry fluff, and meter said fluff to a receptacle or another process, such as an airlaid process.

24 Claims, 6 Drawing Sheets

U.S. PATENT DOCUMENTS 3,660,866 A 5/1972 Jagst
3,795,943 A 3/1974 Eckrodt
3,967,785 A 7/1976 Grosch
4,141,509 A 2/1979 Radzins
4,190,932 A 3/1980 Trützschler
4,190,933 A 3/1980 Jagst
4,297,766 A 11/1981 Trutzschler
4,477,944 A 10/1984 Binder et al.
4,497,448 A 2/1985 Joa et al.
4,557,021 A 12/1985 Nash et al.
4,595,149 A 6/1986 Hergeth
4,623,099 A 11/1986 Vosbein et al.
4,650,127 A 3/1987 Radwanski et al.
4,698,878 A 10/1987 Büschgens et al.
4,707,888 A 11/1987 Binder et al.
4,748,725 A 6/1988 Temburg et al.
4,756,059 A 7/1988 Temburg
4,796,335 A 1/1989 Kranefeld et al.
4,813,616 A 3/1989 Hösel et al.
4,854,171 A 8/1989 Hergeth
4,888,857 A 12/1989 Pinto et al.
4,903,374 A 2/1990 Hösel
4,928,354 A 5/1990 Hanselmann et al.
4,940,464 A 7/1990 Van Gompel et al.
5,123,144 A 6/1992 Demuth et al.
5,163,490 A 11/1992 Meis
5,515,577 A 5/1996 Pinto et al.
5,902,297 A 5/1999 Sauer
5,904,672 A 5/1999 LeMahieu et al.
5,904,675 A 5/1999 Laux et al.

METHOD OF FORMING AND METERING FLUFF PULP

This application is a Division of U.S. patent application Ser. No. 09/748,423, filed on Dec. 26, 2000 now U.S. Pat. No. 6,524,442.

BACKGROUND

People rely on disposable absorbent products to help participate in and enjoy their daily activities.

Disposable absorbent products, including adult incontinence articles, feminine pads, dressings for wounds, and diapers, are generally manufactured by combining several components. These components typically include a liquid-permeable topsheet; a liquid-impermeable backsheet attached to the topsheet; and an absorbent core located between the topsheet and the backsheet. When the disposable article is worn, the liquid-permeable topsheet is positioned next to the body of the wearer and allows passage of bodily fluids into the absorbent core. The liquid-impermeable backsheet helps prevent leakage of fluids held in the absorbent core. The absorbent core is designed to have desirable physical properties, e.g. a high absorbent capacity and high absorption rate, so that bodily fluids can be transported from the skin of the wearer into the disposable absorbent product. Often the absorbent core includes fluff pulp, typically cellulosic in nature, to help achieve these properties.

Fluff pulp is usually formed by unwinding a rolled-up sheet of substantially dry fiber and directing the free end of the sheet to a hammermill. The hammermill typically has rapidly moving metal bars that repeatedly impact, tear, and break the free end of the sheet into individual fibers or fiber aggregates. These individual fibers, fiber aggregates, and other optional materials are then put into a stream of air that is directed to a moving wire; i.e., an airlaid process. The air passes through the wire, but most of the fibers, fiber aggregates, and any optional materials are retained at the surface of the wire to form a fibrous web. This fibrous web is then incorporated into the disposable absorbent product. By adjusting the rate at which the rolled sheet of substantially dry fiber is unwound and fed into a hammermill, a manufacturer can meter the fluff pulp to the airlaid process so that the input of fluff pulp approximates or matches the output of fluff pulp as incorporated into the final product. This method of processing and metering fluff pulp works, but a rolled sheet of dry fiber is generally more expensive than some other forms of dry fiber. For example, flash-dried bales of fiber cost significantly less than roll-form pulp. Flash-dried bales are currently used in wetlaid processes for forming a fibrous web, not the airlaid process described above. In a typical wetlaid process, water and flash-dried bales of fiber are put into a tank having rotating blades. The action of the blades, and the absorption of water by fibers, breaks the bale apart into an aqueous slurry of substantially individual fibers. The aqueous slurry is then directed to a moving wire where the water drains through the wire but fibers are retained on the surface of the wire.

What is needed is a method and apparatus for breaking apart bales of fiber into substantially dry, individual fibers or fiber aggregates, i.e. dry fluff, and metering the dry fluff to a hopper or other receptacle, or other process, such as an airlaid process for use in making disposable absorbent articles.

SUMMARY

The present invention is directed to an apparatus and method that satisfy this need. One version of an apparatus having features of the present invention includes: a bale support member for supporting a bale of pulp, the bale support member defining two openings; two fiberizing assemblies, each having a disrupting-element support member attached to a rotatable shaft; for each fiberizing assembly, a plurality of disrupting elements attached to and extending outwardly from the disrupting-element support member a distance, generally adjustable, sufficient to allow a portion of the disrupting elements to protrude through an opening to contact a surface layer of the bale of pulp, the surface layer having a dimension parallel to the longitudinal axis of the disrupting-element support member, each disrupting element extending longitudinally and substantially continuously along the disrupting-element support member for a distance of about 100% or more of said surface-layer dimension; a transportation assembly for moving the bale of pulp back and forth along the bale support member and over the openings so that the disrupting elements contact a surface layer in the bale to form substantially dry, individual fibers and fiber aggregates, i.e. dry fluff; an adjustable reciprocating assembly attached to and providing a motive force for moving the transportation assembly, the adjustable reciprocating assembly permitting adjustment of the frequency by which the transportation assembly moves back and forth over the opening, the frequency being adjustable from about 1 sec $[\text{stroke}]^{-1}$ to about 50 sec $[\text{stroke}]^{-1}$, and more specifically from about 3 sec $[\text{stroke}]^{-1}$ to about 35 sec $[\text{stroke}]^{-1}$; and a conduction assembly for conducting the dry fluff to a hopper or other receptacle, or another process such as an airlaid process. In some versions of the invention, the apparatus comprises one slot and one or more fiberizing assemblies, or more than two slots and/or two fiberizing assemblies.

One version of an apparatus in which dry fluff is formed from a bale and metered at a desired rate to another process, such as an airlaid process, comprises: a sensor for determining a value $S_1$ corresponding to the amount of dry fluff being used by the other process per unit time; a transmitter for transmitting a value $M_1$ corresponding to the value $S_1$ to a reciprocation frequency controller having instructions for correlating the value $M_1$ to a value $R_1$, the value $R_1$ corresponding to a reciprocation frequency; and a reciprocation frequency controller for operably controlling the adjustable reciprocation assembly to the reciprocation frequency corresponding to the value $R_1$ so that the amount of dry fluff formed per unit time corresponds to the amount of dry fluff being used by the other process per unit time.

Another version of an apparatus in which dry fluff is formed from a bale and metered at a desired rate to another process, such as an airlaid process, comprises: a measurement device for determining the amount of dry fluff being used by the other process per unit time; and a controlling device for force-adjusting the reciprocation frequency to a frequency such that the amount of dry fluff formed per unit time corresponds to the amount of dry fluff being used by the other process per unit time.

One version of a method of fiberizing a bale of pulp into dry fluff and metering the dry fluff to a hopper or other receptacle, or another process, such as an airlaid process, includes the steps of: providing a bale of pulp having a density of about 0.5 g $cm^{-3}$ or greater, specifically about 0.7 g $cm^{-3}$ or greater, and more specifically about 0.9 g $cm^{-3}$ or greater; conveying the bale of pulp to a bale support member so that the bale rests on the bale support member, the support member defining two openings through which disrupting elements protrude; moving the bale of pulp back and forth at an adjustable frequency over the openings so that the disrupting elements, which extend outwardly from disrupting-element support members attached to rotatable shafts, contact a surface layer in the bale of pulp to form dry fluff; selecting a frequency corresponding to a desired amount of dry fluff formed per unit time, for example the amount of dry fluff required to operate another process, such as an airlaid process, per unit time; and conducting the amount of dry fluff formed per unit time to a hopper or other receptacle, or another process such as an airlaid process.

In another version of a method of the present invention, the dry fluff that is formed has a percent-fiberization value of at least about 50%, specifically at least about 75%, particularly at least about 85%, and more particularly at least about 90%.

One version of a method in which dry fiber is formed from a bale and metered at a desired rate to another process, such as an airlaid process, comprises the steps of: sensing a value $S_1$ corresponding to the amount of dry fluff being used by another process per unit time; transmitting a value $M_1$ corresponding to the value $S_1$ to a reciprocation frequency controller, the reciprocation frequency controller having instructions for correlating the value $M_1$ to a value $R_1$, the value $R_1$ corresponding to a reciprocation frequency; using the controller to operably control the adjustable reciprocation assembly to the reciprocation frequency corresponding to the value $R_1$ so that the amount of dry fluff formed per unit time corresponds to the amount of dry fluff being used by the other process per unit time.

Another version of a method in which dry fluff is formed from a bale and metered at a desired rate to another process, such as an airlaid process, comprises the steps of: determining the amount of dry fluff being used by the other process per unit time; and force-adjusting the reciprocation frequency to a frequency such that the amount of dry fluff formed per unit time corresponds to the amount of dry fluff being used by the other process per unit time.

These and other features, aspects, and advantages of the present invention will become better understood with regard to the following description, appended claims, and accompanying drawings.

DRAWINGS

DESCRIPTION

Figure 1:
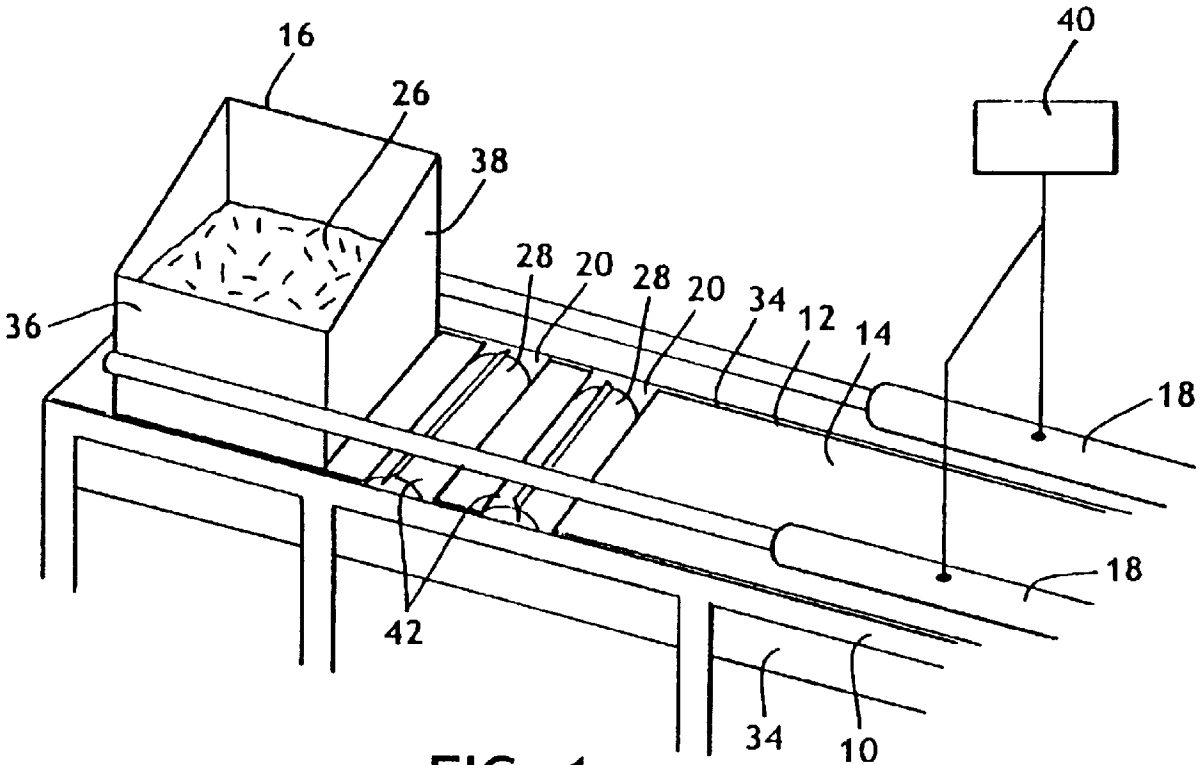
FIG. 1 shows a perspective view of one version of an apparatus embodying features of the present invention.

An apparatus having features of the present invention generally comprises several components. In one version of the apparatus, shown in FIG. 1, a frame 10 is connected to, or is designed to define, a channel 12. The channel comprises a base member 14, which serves as a bale support member. A carriage 16, or other transportation assembly, is positioned in the channel. The carriage is attached to an adjustable reciprocating assembly 18 that moves the carriage back and forth 19 (see FIG. 2) along the channel at a selectable frequency. As shown in FIG. 2, the base member defines two slots 20 through which disrupting elements 22 contact a surface layer 24 in a bale of pulp 26.

The disrupting elements are attached to rotatable fiberizing assemblies 28. The disrupting elements break apart the surface layer of the bale into substantially dry, individual fibers and fiber aggregates; i.e., dry fluff. The height that the disrupting elements extend above the bale-facing surface generally is adjustable so that the approximate thickness of the surface layer engaged by the disrupting elements can be selected. By selecting a thickness of the engaged surface layer and the frequency at which the carriage moves back and forth over the slots, the amount of fluff formed per unit time can be adjusted. Generally, the rotational speed of the rotatable fiberizing assemblies 28 is selected so that there are at least about 6 and ½ disrupting-element strikes at the bale-surface layer per inch of linear travel by the bale.

The dry fluff is conducted to a hopper or other receptacle, or another process. A conduction assembly, such as the vacuum assembly 30 shown in FIG. 2.A, may be used to conduct the dry fluff to a hopper, receptacle, pipe, or other process, such as the airlaid process 32 shown in FIG. 2. Alternatively, a conveyer, gravity-feed device, or some other assembly may be used to conduct the dry fluff to a receptacle or other process. Each of these features, as well as other aspects and embodiments of an apparatus of the present invention, is discussed in more detail below.

For the present application, "dry fluff" means a pulp having a moisture content of about 15% or less, particularly about 10% or less, specifically about 5% or less, and still more specifically about 3% or less. Moisture content is calculated by dividing the mass of water in a given sample of fluff by the sum of the mass of water and the mass of dry fiber in the sample (and multiplying by 100 to give the calculated value in percent). Typically the mass of a sample of dry fluff is determined in the following manner. After a weighing dish and its lid are tared, a sample of dry fluff is placed in the weighing dish and the lid is placed on the weighing dish over the sample. The mass of the sample of dry fluff is then determined. The weighing dish with the sample, and the lid (which is now removed), are placed in an oven pre-heated to 105° C. After a set amount of time, typically about two or more hours, the lid and the weighing dish (which are still separate from one another) are removed from the oven and placed in a dessicator having a desiccant. A cover is placed over the dessicator. After the weighing dish, sample, and lid have cooled, the dessicator cover is then removed, and the lid is immediately placed on the weighing dish over the sample. The mass of the sample of dry fluff is then determined. The difference between the mass of the sample of dry fluff before and after oven drying equals the amount of moisture in the sample. Dividing this value by the mass of the sample of dry fluff before oven drying gives moisture content.

Figure 2:
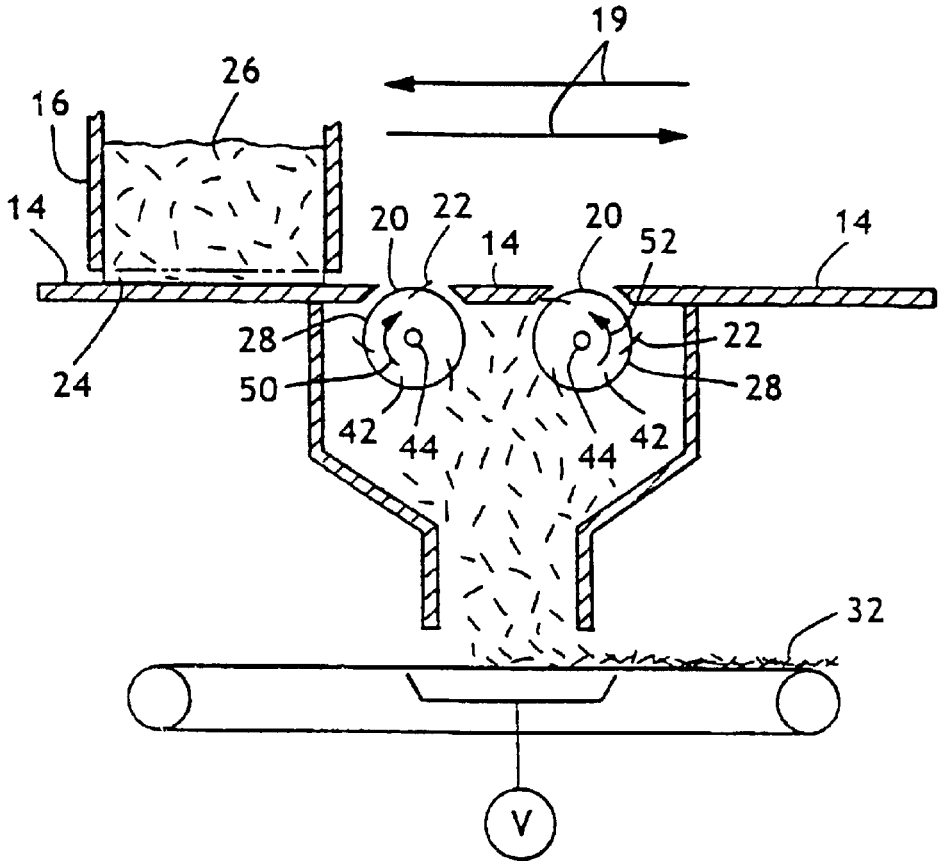
FIG. 2 shows a sectional view of one version of an apparatus embodying features of the present invention.

As stated above, and as shown in FIG. 1, one version of the present invention has a frame 10 that is connected to, or is designed to define, a channel 12. The channel generally comprises two parallel, opposing side walls 34 and a base member 14, with the base member serving as a bale support member. The frame, side walls, and base member may be metal or other rigid material. The base member typically defines at least two slots 20 or other openings permitting fiberizing assemblies 28 (defined below) to contact a surface layer of a bale of pulp as the bale moves over the slots. But, as discussed above, the base member may define one slot or more than two slots. Furthermore, one or more slots may permit one or more fiberizing assemblies to contact a surface layer of a bale of pulp as the bale moves over the slot(s).

A movable carriage 16 is positioned in the channel. The depicted carriage is rectangular, having two opposing side walls 36 connected to two opposing end walls 38. The version of the carriage depicted in FIG. 1 shows opposing side walls of differing dimensions. The length of the dimension perpendicular to the base member for one side wall is greater than the length of the corresponding dimension for the opposing side wall. This geometry facilitates placing bales into the carriage. Other geometries, however, may be used.

The side walls and end walls of the carriage define two openings. The opening in the carriage adjacent to the base member allows one or more bales of pulp inside the carriage to rest on the base member, as well as to contact the fiberizing assemblies when the bale or bales are positioned over the slots (described below). The other opening in the carriage permits the placement of bales of pulp inside the carriage. Possible ways of positioning bales within the carriage include side-by-side placement of two or more bales; stacking two or more bales vertically, one on top of the other; or some combination of these. Other transportation assemblies may be used to move bales of pulp into contact with the disrupting elements of the fiberizing assemblies. For example, a bale of pulp could be carried by a conveyor and deposited directly into the channel, rather than placed in a carriage. Platens attached to opposing hydraulic rams could then be brought into contact with the opposing ends of one or more bales. Coordinated action by the rams would push the bale or bales back and forth over the slots and in contact with the disrupting elements of the fiberizing assembly, thereby producing dry fluff.

In the version of the invention depicted in FIG. 1, the movable carriage will generally further comprise a flange or wheels (not shown in the Figure) attached to each of the opposing side walls of the carriage. The flange or wheels rest on a portion of the frame, or some element attached or proximate to the frame, so that the carriage does not strike the fiberizing assembly as the carriage moves back and forth along the channel.

An adjustable reciprocating assembly 18 is attached to the moveable carriage. The adjustable reciprocating assembly includes, but is not limited to, a hydraulic, pneumatic, mechanical (e.g., a chain drive as shown in U.S. Pat. No. 3,286,745 to T. F. Meis, entitled "Machines for Producing Wood Shavings," which is hereby incorporated by reference in a manner consistent with the present application), or other drive system for moving the carriage back and forth along the channel. The reciprocation frequency with which the carriage moves back and forth along the channel is typically adjustable from about 1 second per stroke to about 50 seconds per stroke, and more specifically from about 3 seconds per stroke to about 35 seconds per stroke. Other reciprocation frequencies ranges may be used depending on the size of the equipment used to convert bales into dry fluff, and, if the dry fluff is directed to another process, the amount of dry fluff being used by the other process per unit time. "Stroke" means the distance traveled by the carriage from a position at one end of the channel—representing one extreme of the range of motion of the adjustable reciprocating assembly—to the other end of the channel—representing the other extreme of the range of motion of the adjustable reciprocating assembly. Two strokes (plus any "dead" time at the end of a stroke when the carriage is momentarily stationary just before the carriage reverses direction) equals one cycle, i.e. one back-and-forth movement of the transportation assembly. Reciprocation frequency may be adjusted by changing the speed at which the carriage moves back and forth along a given length of travel in the channel; by changing the length of travel in the channel at a given carriage speed; or some combination thereof.

To adjust reciprocation frequency, generally a reciprocation-frequency controller 40 will be connected to the adjustable reciprocating assembly. The frequency controller is capable of operably controlling the adjustable reciprocating assembly to a desired reciprocation frequency. Such a controller may take a variety of forms. For example, the controller may be a device that converts a control signal into an equivalent air-pressure, electrical, hydraulic, or other output signal. This air-pressure, electrical, hydraulic, or other output signal is sent from the controller to a control element that effects a change to the variable being manipulated, in this case the reciprocation frequency. If the output signal is an air-pressure signal, the output signal will be transmitted to the control element via tubing. The control element, such as a pneumatic control valve, responds to the output signal by opening or closing, thus effecting the desired change to the variable being manipulated. The control system may include multiple valves: e.g., a two-valve system with one operating as a one-directional, open-or-shut valve and the other operating as a proportional valve. Alternatively, the output signal is converted into an electrical signal. The output signal is relayed to the control element via metal wire or other electrical conductor. The control element, such as an electronic control valve, responds to the electrical signal by opening or closing, thus effecting the desired change to the variable being manipulated.

An operator may input a value directly to the controller to produce a control signal. For example, an operator may adjust a dial or other input device on either a pneumatic or electronic controller to adjust reciprocation frequency. The operator selects a setting on the input device of the controller corresponding to the reciprocation frequency desired by the operator. Typically the operator will have calibrated the input device on the controller so that input-device settings each correspond to specific values of the amount of dry fluff formed per unit time (for a given set of bale characteristics, such as bale type, density, and moisture content; and the selected height at which the disrupting elements extend above the bale-facing surface of a bale support member).

Figure 3:
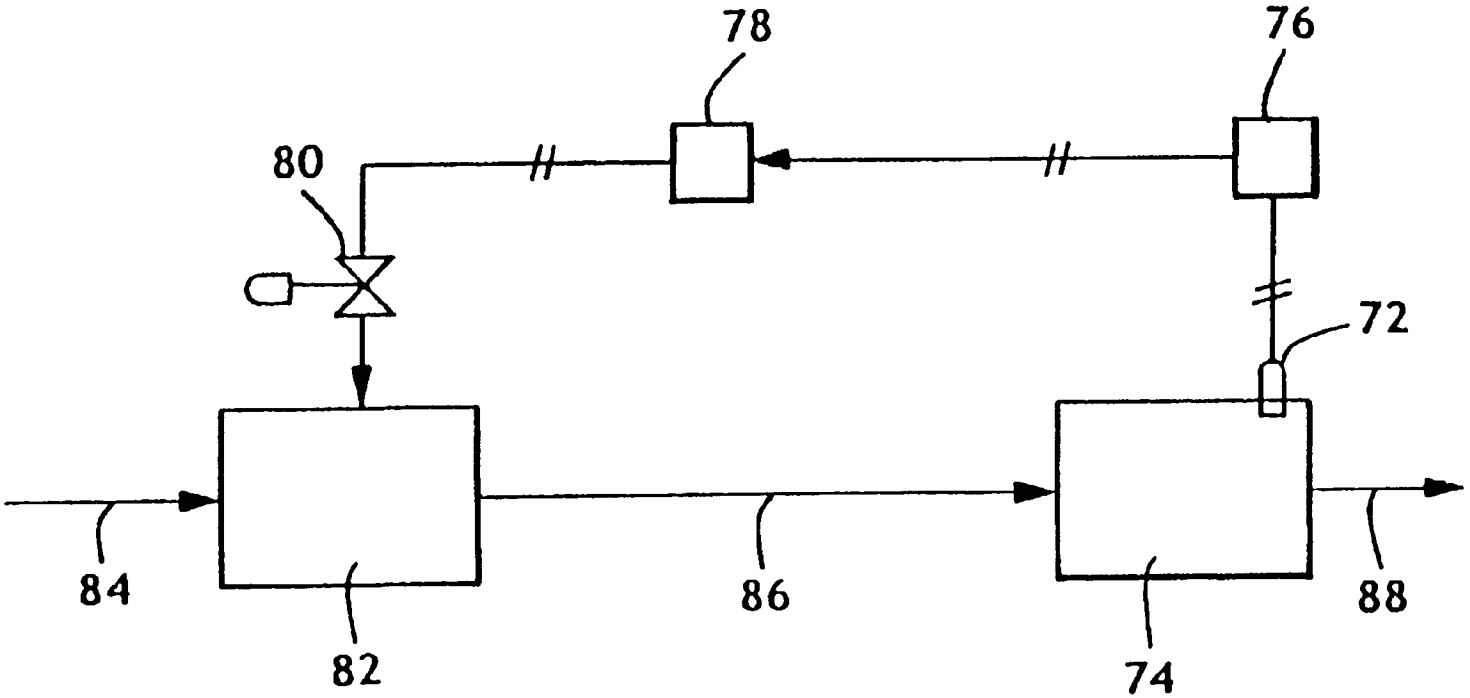
FIG. 3 shows a flow diagram depicting one version of an apparatus embodying features of the present invention.

Alternatively the control signal may be transmitted to the reciprocation-frequency controller from another process. For example, as depicted in FIG. 3, a sensor, 72 may be used to determine a signal $S_1$ corresponding to the amount of dry fluff being used by another process per unit time, e.g. the amount of dry fluff being incorporated into disposable absorbent products per unit time by an air-laid process 74. This signal may then be relayed electrically, pneumatically, or by other means to a transmitter 76, which converts the signal $S_1$ into a control signal $M_1$. The transmitter transmits the control signal $M_1$ to the reciprocation-frequency controller 78.

After receiving the control signal $M_1$, the reciprocation-frequency controller sends the corresponding output signal $R_1$ to the control element 80. The control element, such as an electronic or pneumatic control valve, responds to the output signal $R_1$ by opening or closing, thus effecting the desired change to the variable being manipulated, in this case reciprocation frequency. A process for forming dry fluff 82 is thus controlled to form the amount of dry fiber required by another process 74, with the arrows 84, 86, and 88 representing the flow of bales of pulp, the flow of dry fluff formed per unit time, and the flow of dry fluff used per unit time, respectively.

A general-purpose computer may be used in place of, or in addition to, the controller mentioned above. Typically a general-purpose computer employs an input device, including, but not limited to, an alpha-numeric keyboard, mouse, joystick, stylus, touch screen, or some combination of these. Other devices which may be used to input data to the computer include, but are not limited to: devices for reading data stored on magnetic media such as 3.5 inch "floppy disks" or fixed-drives; devices for reading data stored on optical media, such as CD-ROMs; devices for reading data transmitted over cables, including optical cables; and devices for scanning and digitizing information on a document. In addition to the input devices like those mentioned above, a general-purpose computer usually includes a visual display for displaying data. Also, a general-purpose computer typically has a device for storing and retrieving data that is inputted to the computer. Devices for storing and retrieving data include, but are not limited to: a disk drive for reading data from, and storing data on, a 3.5 inch "floppy disk"; a hard disk or other fixed drive; a tape drive; or other device capable of reading data from, and storing data on, magnetic media.

A general-purpose computer may be adapted for use in controlling the reciprocation frequency. Typically a general-purpose computer comprises devices for data input, data storage, data processing, data display, and data output, as discussed above. For purposes of controlling reciprocation frequency, the general-purpose computer may further comprise a set of instructions comprising the following steps: reading the control signal $M_1$, the control signal $M_1$ being transmitted to the computer in computer-readable form; correlating the control signal $M_1$ to an output signal $R_1$; and transmitting the output signal $R_1$ to a control element. The control element, such as an electronic or pneumatic control valve, responds to the output signal $R_1$ by opening or closing, thus effecting the desired change to the variable being manipulated, in this case reciprocation frequency.

The above discussion provides exemplars of equipment and methods for controlling the amount of dry fluff formed per unit time. It should be understood that other equipment and methods used to force adjust reciprocation frequency such that the amount of dry fluff formed per unit time corresponds to the amount of dry fluff being used by another process per unit time, such as an airlaid process used to make disposable absorbent articles, falls within the scope of the present invention.

Figure 2A:
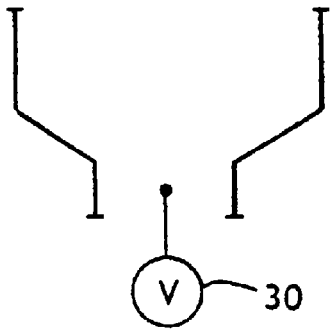
FIG. 2A shows a sectional view of one version of an apparatus embodying features of the present invention.

One version of an apparatus of the present invention includes at least two fiberizing assemblies (but, as mentioned above, and as described below in Example 1, the invention may comprise one fiberizing assembly, or may comprise more than two fiberizing assemblies). The embodiment depicted in FIGS. 1, 2, and 2A shows two fiberizing assemblies 28. Each of the fiberizing assemblies includes a disrupting-element support member 42 having a longitudinal axis. For the version of the invention depicted in these Figures, the disrupting-element support member is generally cylindrical, but other cross-sectional geometries, e.g. a polyhedral cross-section, could be used. Disrupting elements 22 may be attached to a disrupting-element support member in different ways. For example, the disrupting elements may be an integral part of each disrupting-element support member. Alternatively, disrupting elements may be inserted into openings on a disrupting-element support member. For this approach, the disrupting-element support member would be tapped so that screws could be threaded through the taps in the support member and into the openings that receive disrupting elements. The taps and corresponding screws would be placed along the longitudinal axis of the disrupting-element support member so that disrupting elements could be secured to the support member. By tightening screws along the longitudinal axis of the disrupting-element support member, the disrupting elements would be anchored in place.

Figure 4:
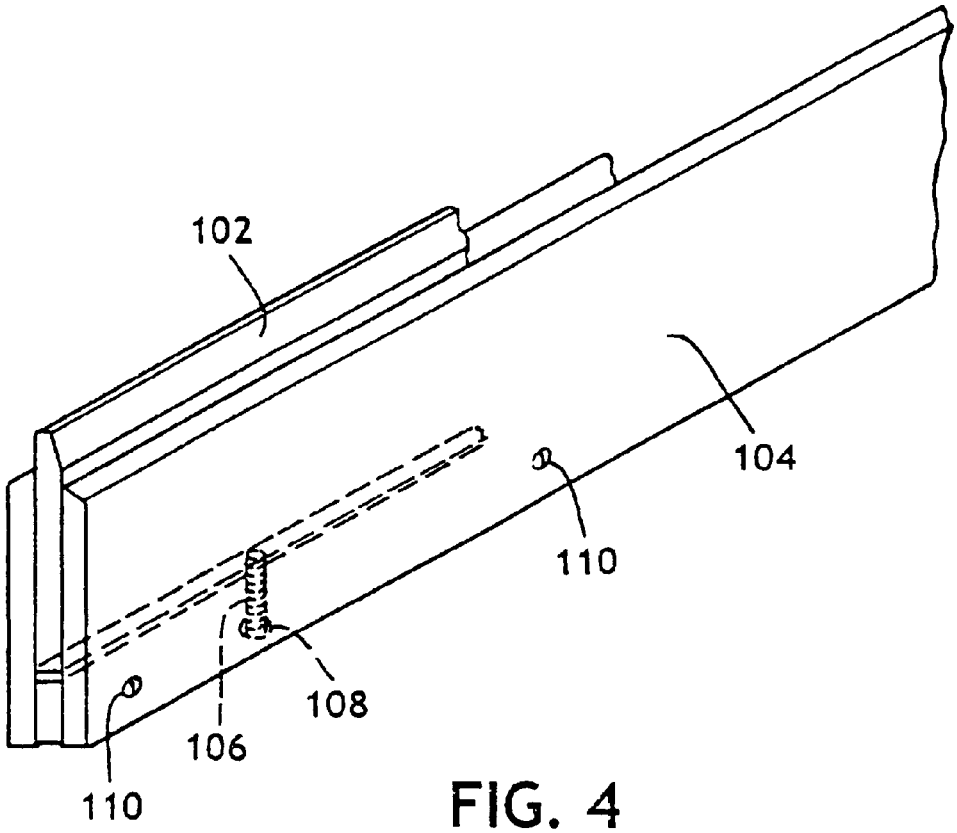
FIG. 4 shows a perspective view of one version of a disrupting element and disrupting-element holder.
Figure 5:
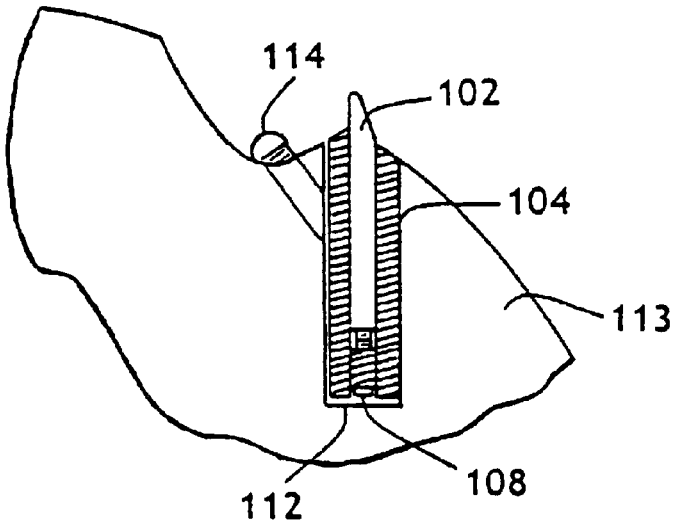
FIGS. 5 and 6 show side views of one version of a disrupting element, a disrupting-element holder, and a disrupting-element support member.

In another aspect, a disrupting element 102 is inserted into a disrupting-element holder 104, as depicted in FIGS. 4 and 5. The holder comprises taps or threaded holes 106 in the bottom of the holder. The taps or threaded holes are designed to receive adjusting screws 108. By tightening or loosening these adjusting screws, the disrupting element can be raised or lowered within the holder. Raising and lowering the disrupting element within the disrupting-element holder permits adjustments of the height of the disrupting elements above the bale-facing surface of the base member of the channel.

Once the adjusting screws have been tightened or loosened as desired, screws 110 are tightened to clamp the disrupting-element holder together, with the disrupting element held in place by friction. The disrupting element holder, together with the disrupting element, is then inserted into an opening 112 in a disrupting-element support member 113. Screws 114 are then threaded into taps or threaded holes in the disrupting-element support member and tightened to anchor the disrupting-element holder and disrupting element in place. Other mechanical devices may be used to anchor the disrupting-element holder and disrupting element in place in the disrupting-element support member including, for example, a wedge device or gib.

Figure 6:
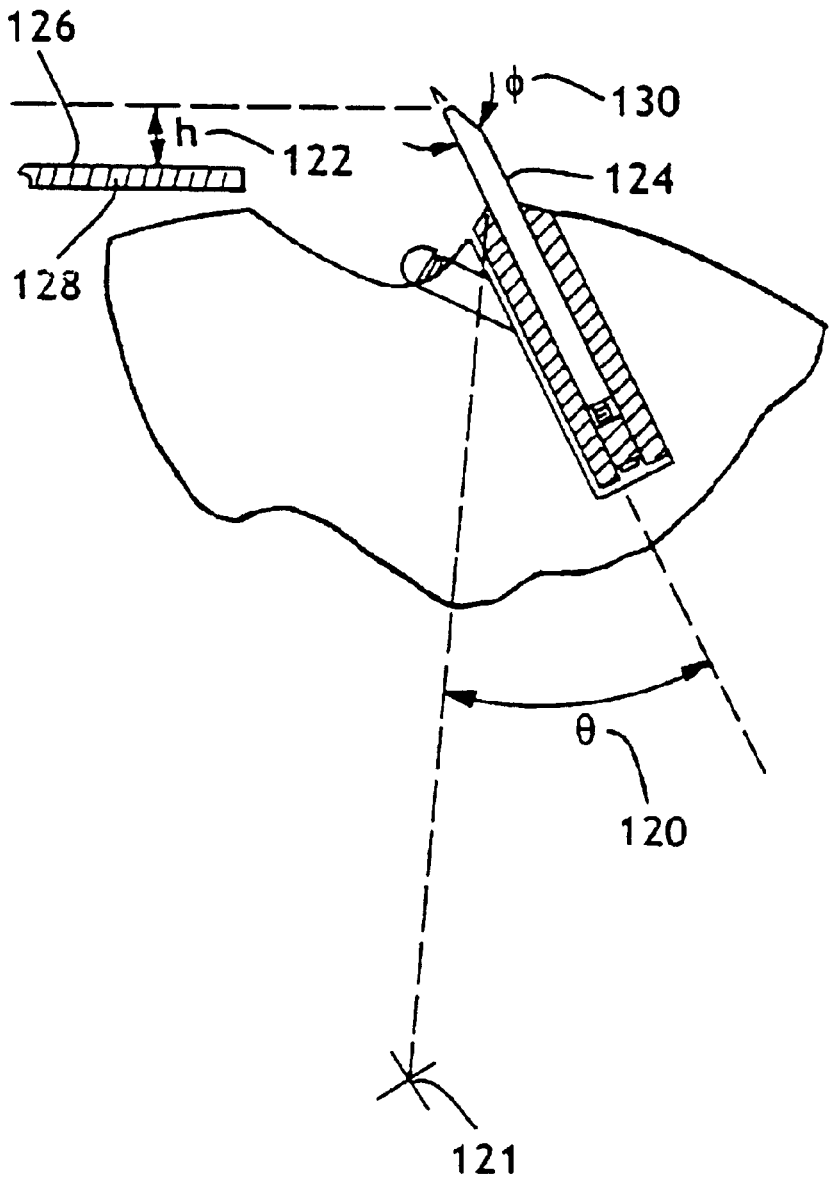

Generally a plurality of disrupting elements will be attached to the disrupting-element support member. Typically there will be 2 or more, specifically 3 or more, more specifically 4 or more, and particularly 5 or more disrupting elements attached to a disrupting-element support member. But different numbers of disrupting elements could be used in an apparatus and method of the present invention. The tips of the disrupting elements will typically be of a form that transforms a surface layer in a bale of pulp into substantially individual fibers and fiber aggregates; e.g., a slightly dulled edge. A sharp, knife-like edge may produce shavings, not substantially individual fibers and fiber aggregates. Accordingly, disrupting elements with sharp, knife-like edges may not be suitable for producing the types of dry fluff needed to make certain absorbent structures and disposable absorbent products. The embodiment depicted in the Figures shows the disrupting elements extending outwardly from the disrupting-element support member at a holder angle θ. The invention encompasses a holder angle θ 120, as depicted in FIG. 6 (not to scale; the center point of the fiberizing assembly is numbered as 121), typically ranging from about 5 degrees to about 35 degrees, suitably from about 10 to about 30 degrees, and specifically from about 15 to about 25 degrees. Also, as discussed above, the maximum height h 122 that the disrupting element 124 extends above the bale-facing surface 126 of a bale-support member 128 can be adjusted by adjusting placement of a disrupting element within a disrupting-element holder using adjusting screws 108 on the bottom of the holder. Alternatively, or in addition to, this adjustment of the disrupting element within the disrupting-element holder, the shaft of the fiberizing assembly may itself be vertically adjusted (discussed below).

The geometry of the disrupting elements may also be varied for purposes of the invention. The disrupting element tip angle ϕ 130, also depicted in FIG. 6, generally may be from about 25 to about 60 degrees, suitably from about 30 to about 50 degrees, and specifically from about 35 to about 40 degrees. For a given bale density and fiber type, the number of disrupting elements n, the holder angle θ, and the disrupting-element tip angle ϕ may be selected to produce a fluff pulp having desired physical characteristics. Generally the desired fluff pulp will comprise substantially individual fibers and fiber aggregates. As stated above, the fluff pulps will typically be cellulosic in nature, with the fibers generally having a diameter between about 7 and 40 micrometers; and a length between about 0.5 and 5 mm, more particularly between about 1 and 3 mm.

A large number of fiber aggregates is undesirable for some personal-care applications. Accordingly, for some disposable absorbent articles or absorbent structures comprising a dry fluff pulp, the fluff pulp made in accordance with the present invention will have a percent-fiberization value of about 50% or more, particularly about 75% or more, specifically of about 85% or more, and more specifically of about 90% or more. For the present application, "percent-fiberization value" is determined as follows. The test instrument is a canister having a diameter of 10.25 inches and a height of 9 inches. The bottom of the canister incorporates a 6-inch diameter 12×12 mesh screen, with the screen located in the center of the bottom portion of the canister. So that air may be pulled through the screen, a nozzle is connected to the bottom of the canister and to a 2-inch hose attached to a vacuum source. The side of the canister incorporates a 1-inch-diameter air-intake port about ⅛ of an inch above the bottom portion of the canister. The specific procedure involves the following steps: 1. Clean screen and inside of canister. 2. Weigh out 10.0±0.1 gram of the dry fluff to be tested. 3. Break the fluff into approximately 1-inch square pieces and place it loosely in the canister; then place a lid on the canister. 4. With a timer set for 4 and ½ minutes, push the start button that activates the vacuum. Look at the vacuum gauge to make sure it is at 8.0 inches of water (the vacuum gauge is attached to the nozzle). If not, adjust the vacuum to obtain a readout of 8.0 inches of water. 5. After the test has run for 4 and ½ minutes, shut the vacuum off, remove all the fluff remaining in the canister (i.e., that fiber which has not been pulled through the screen) and weigh to the nearest 0.1 gram. 6. Multiply the weight of the fluff by 10 and subtract from 100. Report this difference as percent fiberization. The mesh of the screen is designed to allow separate fibers to pass through the screen and to retain fibers that are not fully separated. Theoretically, with 100 percent fiberization, all fibers would pass through the screen. If the amount of fiber remaining in the vacuum chamber was 0.1 gram, the test would report 99 percent fiberization.

Each disrupting element extends substantially continuously along the longitudinal axis of the disrupting-element support member for a distance of 100% or more of the bale surface-layer dimension that is parallel to the longitudinal axis of the disrupting-element support member. The disrupting element may be comprised of discontinuous elements, as long as these discontinuous elements, when taken together, extend substantially continuously along the longitudinal axis of the disrupting-element support member for a distance of 100% or more of the bale surface-layer dimension as discussed above. In effect, the disrupting elements are capable of fiberizing a surface layer of the bale along the total length of the surface-layer dimension that is parallel to the longitudinal axis of the disrupting-element support member when the bale surface layer contacts the disrupting elements of the fiberizing assembly. By systematically removing entire surface layers of the bale, the disrupting elements allow for the bale to incrementally drop with back-and-forth passes over the fiberizing assemblies.

The edge of a disrupting element that contacts a surface layer in a bale of pulp, or the edges of discontinuous elements that make up a disrupting element, may be scalloped, fluted, serrated, or shaped in some other fashion. As discussed above, however, a slightly dulled edge is typically used to produce substantially individual fibers with some fiber aggregates. A sharp, knife-like edge, on the other hand, may produce shavings that are unacceptable for certain absorbent structures and disposable absorbent articles. If a sharp, knife-like edge produces such shavings, the shavings will likely have percent-fiberization values far less than 50%.

A disrupting element may curve along its length as it extends from one end of the disrupting-element support member to the other end of the support member. Similarly, discontinuous elements that make up a disrupting element may curve along their lengths from one end of the disrupting-element support member to the other end of the support member.

For embodiments of the invention employing two fiberizing assemblies, the assemblies generally are mounted in close proximity to one another. Each fiberizing assembly is constructed so that the disrupting-element support member is attached to a shaft 44 (FIG. 2). The shaft may be adjustably journaled to permit adjustments of the height of the disrupting elements above the bale-facing surface of the base member of the channel. Alternatively, as discussed above, the disrupting-element holder may incorporate adjusting screws 108 in the bottom of the holder that allow adjustment of the height of the disrupting elements above the bale-facing surface of the base member of the channel.

An apparatus of the present invention is used to produce dry fluff in the following manner. First disrupting elements of a selected geometry are inserted into the disrupting element holders 104. Typically a holder will have a U-shape. At the bottom of the holder, screws 108 or other adjusting members are turned or adjusted to select how far a disrupting element protrudes out of the holder. This adjustment directly influences the height h 122 of the disrupting elements above the bale-facing surface 126 of the base member of the channel. Once this adjustment is made, another set of screws 110 or other tightening members are tightened or adjusted to clamp the holder together and to secure the disrupting element. The holders and their corresponding disrupting elements are then inserted into openings on the disrupting-element support member 113. Set screws, wedges, gibs, or other mechanical devices are used to anchor the disrupting-element holders and disrupting elements to the disrupting-element support member.

Bales of pulp 26 are then placed in the carriage (FIGS. 1 and 2). While bales of pulp come in different sizes, a typical bale has a width of 24 inches (60 cm), a length of 31 inches (80 cm), and a height of 20 inches (50 cm). Bales also come in a variety of bulk densities, including a bulk density of about 0.5 g $cm^{-1}$ or more, particularly about 0.7 g $cm^{-3}$ or more, and specifically about 0.9 g $cm^{-3}$ or more. For a bulk density of 1.0 g $cm^{-3}$, a bale with the above dimensions would weigh approximately 530 $lb_m$ (240 kg).

Figure 7:
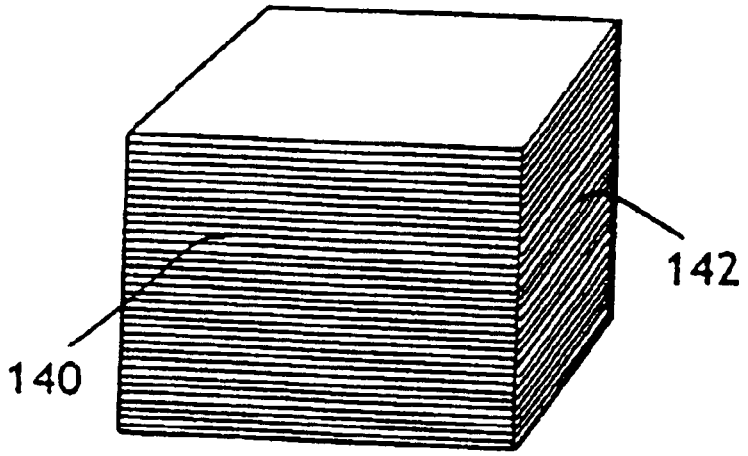
FIGS. 7 and 8 show perspective views of different versions of pulp bales.

Bales of pulp are produced using various types of fibers or fiber blends. For example, bales of pulp may comprise a bleached softwood kraft pulp (BSWK), a bleached hard-wood kraft pulp (BHWK), or some combination thereof. Generally bales of kraft pulp are made by: using a wetlaid process to form a continuous web comprising kraft fibers; drying the web; cutting the web into individual plies, which are generally square or rectangular in shape; and stacking a suitable number of the plies to form a bale. A bale formed in this way typically has a density between about 0.4 and 0.6 g $cm^{-3}$, and is analogous to a deck of cards, with the individual cards representing the individual plies comprising kraft fibers. Using the present invention, this type of bale is typically fiberized by positioning the bale in a carriage or other transportation assembly so that the edges of the individual plies in the bale, i.e. in the above analogy, the edges of individual cards in a deck of cards, are engaged by the rotating disrupting elements. Accordingly, as depicted in FIG. 7, the bale would be positioned in the carriage so that one of the sides 140 or 142 was engaged by the rotating fiberizing assemblies.

Bales may also be composed of high-yield pulp fibers. As used herein, "high yield pulp fibers" are those papermaking fibers produced by pulping processes providing a yield of about 65 percent or greater, more specifically about 75 percent or greater, and still more specifically from about 75 to about 95 percent. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield kraft pulps, all of which leave the resulting fibers with high levels of lignin. Suitable high-yield pulp fibers are characterized by being comprised of comparatively whole, relatively undamaged tracheids, high freeness (over 250 Canadian Standard Freeness, or CSF), and low fines content (less than 25 percent by the Britt jar test).

Figure 8:
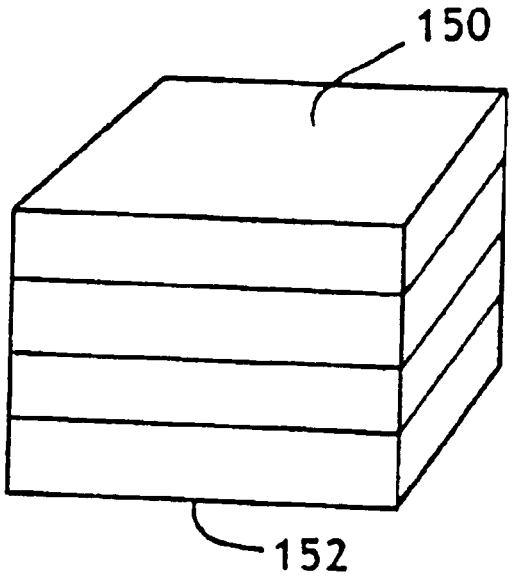

Bales of high-yield fibers may be made in a manner different from the process of making bales of kraft fibers. For example, high-yield fibers may be flash dried in a multi-step operation in which the fibers are systematically exposed to hot air. The flash-dried fibers are then directed to a chamber where they are compressed, typically by a hydraulic device, to form a slab, or "cookie." With the slab still in the chamber, another batch of flash-dried fibers is introduced, and the newly introduced fibers, together with the earlier-made slab, are compressed. The result is two slabs compressed together. Typically this process is repeated two more times so that the final bale of flash-dried pulp comprises four slabs, or cookies, as depicted in FIG. 8. Flash-dried bales may have densities of about 0.9 g $cm^{-3}$ or more.

Using the present invention, this type of bale is typically fiberized by positioning the bale in a carriage or other transportation assembly so that a side of the bale that was perpendicular to the direction of compression, i.e. either side 150 or 152 as depicted in FIG. 8, is engaged by the disrupting elements.

The selected bales are placed in, or directed to, the carriage by a conveyance member, such as a conveyor, crane, chute, or other conveyance device or system. Depending on the size of the carriage, multiple bales may be stacked one on top of the other inside the carriage Also, bales may be placed side-by-side in the carriage. An apparatus and method of the present invention may be operated in batch mode or in continuous mode. For a continuous process, as one or more bales are converted into dry fluff, one or more bales may be intermittently deposited into the carriage—at the end of a stroke, for example.

The power source used to rotate the fiberizing assemblies is then activated, and the rotational speed of the fiberizing assemblies is set. For the embodiment depicted in FIG. 2, two fiberizing assemblies are present, and the direction of rotation of each of these assemblies is opposite one another (50 and 52). For the depicted embodiment, the direction component of the velocity vector emanating from a disrupting element tip contacting a bale surface layer is opposite the direction component of the velocity vector of the carriage for the second fiberizing assembly encountered by the bale during a given stroke. The adjustable reciprocating assembly is either activated at the same time that the rotational motion of the fiberizing assemblies is initiated, or is activated separately. After the adjustable reciprocating assembly is activated, the frequency is selected. The frequency typically is adjustable from about 1 sec $[stroke]^{-1}$ to about 50 sec $[stroke]^{-1}$, and particularly from about 3 sec $[stroke]^{-1}$ to about 35 sec $[stroke]^{-1}$. As discussed above, other frequency ranges may be appropriate depending on, for example, the size of the equipment used to fiberize a bale in accordance with the present invention. Generally a frequency is selected that corresponds to a desired amount of dry fluff to be formed per unit time. For a given type of bale (e.g., having a specific density and composed of a certain fiber type) and a selected height h (see above discussion and FIG. 6), an operator can empirically correlate selected frequencies to masses of dry fluff formed per unit time. Thereafter this empirical correlation can be used to select the amount of dry fluff formed per unit time. When an apparatus of the present invention is used to form dry fluff that is conducted to an airlaid process, the selected frequency will likely correspond to the amount of dry fluff required by the airlaid process per unit time. The amount of dry fluff required by the airlaid process will likely change depending on whether the airlaid process is ramping up to a substantially steady-state production rate, is at a substantially steady-state production rate, or is ramping down from a substantially steady-state production rate. Either an operator can change the reciprocation frequency so that the amount of dry fluff formed per unit time substantially matches the amount being used by the airlaid process, or, as discussed above, a control system—with or without a computer—may be used to force adjust the reciprocation frequency to that which substantially matches the current production rate of the airlaid process. Initial passes of a bale over the fiberizing assemblies may produce dry fluff of a less uniform quality if there are irregularities in the surface of the bale.

Activation of the adjustable reciprocating assembly causes the carriage to move back and forth over the opening, thereby bringing a surface layer of one or more bales of pulp into contact with the rotating fiberizing assemblies. The disrupting elements of the fiberizing assemblies strike the surface layer of the bale as the bale passes over the fiberizing assemblies. As the disrupting elements strike the surface layer, individual fibers and fiber aggregates are liberated from the bale of pulp.

After a surface layer of a bale has been transformed into individual fibers and fiber aggregates, the bale—and any bales that are stacked above it—fall into a slightly lower position by the action of gravity. As the carriage moves back and forth over the opening, new surface layers are exposed for conversion into dry fluff by the action of the disrupting elements. If the process is operated in continuous fashion, then bales may be introduced intermittently. Typically the total mass of the bales will not be allowed to decrease below a certain value or "chattering" may result; i.e., the action of the fiberizing assemblies will knock a bale or bale fragment upwards, likely causing a reduced rate of fiberization. For flash-dried bales weighing about 550 pounds on equipment described in Example 2, chattering typically began when half a bale bad been fiberized (i.e., about 200 to 250 lbs remained) and no more bales or bale fragments had been stacked on top of the remaining half bale.

The dry fluff that is formed can be directed to a hopper or other receptacle, either directly or through a pipe, conduit, flexible hose, or other device capable of conducting the dry fluff from the fiberizing apparatus to another location. Alternatively, the dry fluff may be directed to another process, such as an airlaid process.

Dry fluff made in accordance with the present invention may be incorporated into a number of substrate composites, absorbent cores, structures, and/or disposable absorbent articles. Examples of such substrate composites and/or disposable absorbent articles are described in U.S. Pat. No. 4,940,464, entitled "Disposable Incontinence Garment or Training Pant," which is hereby incorporated by reference in its entirety; U.S. Pat. No. 5,904,675, entitled "Absorbent Article with Improved Elastic Margins and Containment System," which is hereby incorporated by reference in its entirety; U.S. Pat. No. 5,904,672, entitled "Absorbent Article having Improved Waist Region Dryness and Method of Manufacture," which is hereby incorporated by reference in its entirety; and U.S. Pat. No. 5,902,297, entitled "Absorbent Article Having a Collection Conduit," which is hereby incorporated by reference in its entirety. It should be understood that the present invention is applicable to other structures, composites, cores, or products incorporating dry fluff.

EXAMPLE 1

A wood jointer, model no. DJ15 manufactured by Delta International Machinery Company, a business having offices in Pittsburgh, Pa., was used to generate dry fluff from small rectangular blocks taken from a commercial bale of pulp. The wood jointer comprised a support member having a workpiece-facing surface, the support member defining an opening; and a single, vertically adjustable, rotatable fiberizing assembly having 3 disrupting elements. The disrupting elements each extended longitudinally along the rotatable fiberizing assembly for a distance of about 15 cm. Furthermore, the disrupting elements each had a thickness of about 1.3 cm, with the thickness at the very tip of the blade at about 0.005 cm (the tip was dulled so that it did not create shavings when contacting blocks obtained from a bale of pulp). Each element was attached to a rotatable fiberizing assembly such that the holder angle $\theta$ was 30 degrees and the disrupting element tip angle $\phi$ was 45 degrees. The position of the rotatable fiberizing assembly relative to the support member was adjusted so that the tip of each disrupting element reached a maximum distance of 0.16 cm above the workpiece-facing surface of the support member.

Several sample blocks were obtained from a commercial bale of pulp. The bale was a softwood, bleached, chemithermomechanical pulp obtained from Miller Western, a business having offices in Manitoba, Alberta, Canada. The bale of pulp had a density of approximately 0.94 g $cm^{-3}$. Several blocks were cut from the bale. The blocks measured 2.54 cm×2.54 cm×2.54 cm.

The power source for the rotatable fiberizing assembly was an A.C. motor. The motor was activated such that the rotatable fiberizing assembly reached a rotational speed of 4500 rpm. The blocks were placed on the workpiece-facing surface of the support member and were manually passed over the opening and in contact with the disrupting elements of the rotating fiberizing assembly. Sufficient downward pressure was maintained on the block while engaged by the fiberizing assembly to avoid chattering. When a surface layer of the block was engaged by the disrupting elements, the direction of rotation of a disrupting element contacting the block was opposite the direction of movement of the block along the support member; i.e. the direction of a tangential velocity vector emanating from the tip of a disrupting element when the tip engaged a surface layer of the sample block was opposite the direction of movement of the block along the support member.

Repeated passes of a block along the support member and in contact with the rotating disrupting elements transformed successive surface layers of the sample block into substantially individual fibers and fiber aggregate. The resulting fluff was visually observed to have a percent-fiberization value of about 85% or above.

EXAMPLE 2

A wood shaving mill, model number 30D-6 manufactured by Jackson Lumber Harvester Company, a business having offices in Mondovi, Wis., was modified for use in fiberizing bales of pulp into dry fluff. An unmodified version of a wood shaving mill is disclosed in U.S. Pat. No. 3,286,745 to T. F. Meis, entitled "Machines for Producing Wood Shavings," which is hereby incorporated by reference in a manner consistent with the present application.

The reciprocation assembly of the purchased shaving mill was changed so that the reciprocation frequency of the carriage was selectable from about 3 sec $[\text{stroke}]^{-1}$ to about 35 sec $[\text{stroke}]^{-1}$. A manifold was then positioned around the fiberizing assemblies so that dry fluff generated from bales of pulp could be removed by vacuum and conducted to a receptacle or another process such as an airlaid process. One end of a flexible hose with an inside diameter of 20 cm was connected to the manifold. The other end of the hose was connected to the inlet of a variable-speed blower used to create a vacuum at the manifold. Disrupting element holders were modified to include screws in the bottom of the holders so that the height of the disrupting elements above the bale-facing surface of the support member could be adjusted.

Each of 5 disrupting elements was attached to its respective disrupting-element holder and disrupting-element support member such that the holder angle $\theta$ was 15 degrees and the disrupting-element tip angle $\phi$ was 30 degrees. The disrupting elements each extended longitudinally along the disrupting-element support member for a distance of about 70.5 cm. Furthermore, the disrupting elements each had a thickness of about 0.4 cm (the thickness of that portion of the disrupting element engaged by the disrupting-element holder was about 1 cm), with the thickness at the very tip of the blade at about 0.025 cm (the tip was dulled so that it did not create shavings when contacting a bale of pulp). The position of the disrupting elements relative to the disrupting-element support member was adjusted so that the tip of each disrupting element reached about 0.4 cm from the bale-facing surface of the bale support member. This was repeated for the second fiberizing assembly. As stated above, each of the disrupting element tips was dull; i.e., the tips were not so sharp that shavings, rather than individual fibers or fiber aggregates, would be produced.

Bales comprising a softwood, bleached, chemithermomechanical pulp were obtained from Miller Western, a business having offices in Manitoba, Alberta, Canada. The bales of pulp had a density of approximately 0.94 g $cm^{-3}$ and general dimensions as discussed above.

The power source for the rotatable fiberizing assembly was an A.C. motor. The motor was activated such that the rotatable fiberizing assemblies reached a rotational speed of 3600 rpm. The direction of rotation of the fiberizing assemblies was as depicted in FIG. 2. Bales were introduced to the carriage. Back-and-forth movement of the carriage was initiated at reciprocation frequencies ranging from about 15 to about 20 sec $[stroke]^{-1}$. Repeated passes of the bales over the slots such that bale surface layers were engaged by the rotating fiberizing assemblies formed dry fluff having a measured percent-fiberization value ranging from about 75% to about 85%. The experiment was repeated with a reciprocation frequency of about 7 or 8 sec $[stroke]^{-1}$. The resulting dry fluff had a measured percent-fiberization value of about 50 to 60%.

Although the present invention has been described in considerable detail with reference to certain versions, other versions are possible. The spirit and scope of the appended claims should not be limited to the description of specific versions contained herein.

What is claimed is:

1. A method for fiberizing a bale of pulp into dry fluff and metering the dry fluff to an airlaid process, the method comprising the steps of:

providing a bale of pulp having a density greater than 0.5 g $cm^{-3}$;

conveying the bale of pulp to a support member, the support member defining an opening through which disrupting elements protrude from below the support member;

moving the bale of pulp back and forth over the opening at an adjustable frequency using a reciprocation assembly so that the disrupting elements, which extend outwardly from a disrupting-element support member attached to a rotating shaft, contact a surface layer in the bale of pulp to form dry fluff;

selecting a frequency so that the mass of dry fluff formed per unit time corresponds to the mass of dry fluff required by the airlaid process per unit time; and conducting the mass of dry fluff formed per unit time to the airlaid process.

2. The method of claim 1 wherein the bale of pulp has a density greater than 0.7 g $cm^{-3}$.

3. The method of claim 1 wherein the bale of pulp has a density greater than 0.9 g $cm^{-3}$.

4. The method of claim 1 wherein the bale of pulp comprises chemithermomechanical fiber.

5. The method of claim 1 wherein the disrupting-element support member has a longitudinal axis, the bale of pulp has a surface layer having a dimension parallel to the longitudinal axis of the disrupting element support member, and each disrupting element extends longitudinally along the disrupting element support member for a distance of about 100% or more of said surface-layer dimension.

6. The method of claim 1 wherein the frequency is selected by the steps comprising:

sensing a value $S_1$ corresponding to the mass of dry fluff being used by the airlaid process per unit time;

converting the value $S^1$ to a control signal $M_1$;

transmitting the control signal $M_1$ to a reciprocation-frequency controller, the controller converting the control signal $M_1$ into an output signal $R_1$; and transmitting the output signal $R_1$ to a control valve, the control valve adjusting the reciprocation frequency of the reciprocation assembly so that the mass of dry fluff formed per unit time is force adjusted toward the mass of dry fluff being used by the airlaid process per unit time.

7. The method of claim 1 wherein the airlaid process is used, at least in part, to incorporate dry fluff into an absorbent core or disposable absorbent article.

8. The method of claim 6 wherein the airlaid process is used, at least in part, to incorporate dry fluff into an absorbent core or disposable absorbent article.

9. A method for fiberizing a bale of pulp into dry fluff and metering the dry fluff to a destination, comprising the steps of:

providing a bale of pulp having a density of at least about 0.5 g $cm^{-3}$ conveying the bale of pulp to a support member, the support member defining first and second openings through which disrupting elements protrude from below the support member;

moving the bale back and forth over the openings at an adjustable frequency using a reciprocation assembly so that the disrupting elements contact a surface layer in the bale of pulp to form dry fluff;

selecting the frequency to provide a desired amount of dry fluff per unit time; and conducting the dry fluff to the destination.

10. The method of claim 9, wherein the dry fluff has a density of at least about 0.7 g $cm^{-3}$.

11. The method of claim 9, wherein the dry fluff has a density of at least about 0.9 g $cm^{-3}$.

12. The method of claim 9, wherein the step of selecting the frequency comprises the steps of:

sensing a value $S_1$ corresponding to the desired amount of dry fluff per unit time;

converting the value $S_1$ to a control signal $M_1$;

transmitting the control signal $M_1$ to a reciprocation-frequency controller which converts the control signal $M_1$ into an output signal $R_1$; and transmitting the output signal $R_1$ to a control valve which adjusts the reciprocation frequency of the reciprocation assembly so that the mass of dry fluff formed per unit time is adjusted toward the desired amount of dry fluff per unit time.

13. The method of claim 9, further comprising the step of moving the disrupting elements protruding from the first opening and the disrupting elements protruding from the second opening in opposite directions.

14. The method of claim 13, wherein the disrupting elements protruding from the first opening and the disrupting elements protruding from the second opening are attached to counterrotating shafts.

15. The method of claim 9, wherein the destination comprises an airlaid process.

16. A method for fiberizing a bale of pulp into dry fluff and metering the dry fluff to a destination, comprising the steps of:

providing a bale of pulp having a density greater than 0.5 g $cm^{-3}$;

conveying the bale of pulp to a support member, the support member defining at least one opening through which disrupting elements protrude from below the support member;

moving the bale back and forth over the at least one opening using a reciprocation assembly;

moving the disrupting elements in contact with the moving bale to form dry fluff; and conducting the dry fluff to the destination.

17. The method of claim 16, wherein the support member defines first and second openings through which disrupting elements protrude.

18. The method of claim 17, further comprising the step of moving the disrupting elements protruding from the first opening and the disrupting elements protruding from the second opening in opposite directions.

19. The method of claim 16, wherein the dry fluff has a percent fiberization value of at least about 50%.

20. The method of claim 16, wherein the dry fluff has a percent fiberization value of at least about 75%.

21. The method of claim 16, wherein the dry fluff has a percent fiberization value of at least about 85%.

22. The method of claim 16, wherein the bale of pulp comprises chemithermomechanical fiber.

23. The method of claim 16, wherein the dry fluff has a density of at least about 0.7 g $cm^{-3}$.

24. The method of claim 16 wherein the dry fluff has a density of at least about 0.9 g $cm^{-3}$.

* * * * *